US005131201A

United States Patent [19]

Larson et al.

[11] Patent Number: 5,131,201

[45] Date of Patent: Jul. 21, 1992

[54] PRECAST CONCRETE PANELS AND SUPPORT PEDESTALS CONSTRUCTED THEREFROM

[75] Inventors: Greg A. Larson, Ames; Maurice D. Reimers, Des Moines, both of Iowa; Nelson D. Smith, Fullerton, Calif.; James M. Braden, Des Moines, Iowa

[73] Assignee: Pitt-Des Moines, Inc., Des Moines, Iowa

[21] Appl. No.: 672,038

[22] Filed: Mar. 19, 1991

Related U.S. Application Data

[62] Division of Ser. No. 550,944, Jul. 11, 1990, abandoned.

[51] Int. Cl.[5] ..... E04B 1/21

[52] U.S. Cl. ..... 52/583; 52/227; 52/249; 52/593; 52/594; 52/587; 52/563; 52/565

[58] Field of Search ..... 52/747, 227, 249, 247, 52/245, 593, 594, 587, 561, 562, 563, 564, 565, 228, 229, 583, 224, 601

[56] References Cited

U.S. PATENT DOCUMENTS

| | | | |
|---|---|---|---|
| 1,031,050 | 7/1912 | Conzelman | 52/247 |
| 2,483,175 | 9/1949 | Billner | 52/224 |
| 2,958,983 | 1/1960 | Hoover | 52/583 |
| 4,147,009 | 4/1979 | Watry | 52/228 X |
| 4,172,346 | 10/1979 | Kuroiwa | 52/583 X |
| 4,195,457 | 4/1980 | Kissling et al. | 52/245 X |
| 4,312,167 | 1/1982 | Cazaly et al. | 52/745 |
| 4,327,531 | 5/1982 | Cazaly et al. | 52/73 |
| 4,403,460 | 9/1983 | Hills | 52/745 |
| 4,486,989 | 12/1984 | DesRochers et al. | 52/194 |
| 4,578,921 | 9/1986 | Cazaly et al. | 52/741 |
| 4,660,336 | 9/1987 | Cazaly et al. | 52/192 |
| 4,676,035 | 6/1987 | Gangarao | 52/583 X |
| 4,724,649 | 2/1988 | Lowndes, III | 52/601 X |

FOREIGN PATENT DOCUMENTS

| | | | |
|---|---|---|---|
| 3106119 | 9/1982 | Fed. Rep. of Germany | 52/561 |
| 79138 | 2/1919 | Switzerland | 52/249 |

*Primary Examiner*—David A. Scherbel
*Assistant Examiner*—Robert Canfield
*Attorney, Agent, or Firm*—Shoemaker and Mattare, Ltd.

[57] ABSTRACT

A composite elevated storage tank is constructed utilizing precast concrete panels for a pedestal which supports a steel storage tank. The precast concrete panels are poured in a controlled environment not subject to the difficulties inherent with sitecast concrete construction. A simple and practical method of attaching the panels to each other as well as to the foundation and steel tank ensures the concrete pedestal behaves as a shell to sustain all loads. This method, which uses cast in plates welded together at vertical joints and vertical aligned threaded rods for horizontal joints, serves to reduce the length of time required to construct a composite elevated tank and also reduces the construction costs.

13 Claims, 3 Drawing Sheets

PRECAST CONCRETE PANELS AND SUPPORT PEDESTALS CONSTRUCTED THEREFROM

This is a division of application Ser. No. 550,944, filed Jul. 11, 1990, now abandoned.

This invention relates to a precast concrete panel, a support pedestal constructed therefrom and methods of construction suitable for constructing such a support pedestal, the pedestal being suitable for supporting an elevated liquid storage tank consisting of a welded steel liquid-containing tank portion supported atop the support pedestal.

BACKGROUND OF THE INVENTION

Historically, most elevated liquid storage tanks in the USA have been constructed entirely of mild carbon steel. During the past ten years, the concept of "composite" elevated tanks has been introduced within the USA. A composite elevated tank utilizes both steel and reinforced concrete. The storage tank (the liquid containing boundaries) are generally constructed of steel and the supporting structure is constructed of reinforced concrete. This method generally utilizes each construction material to its principal advantage; steel as a liquid-tight membrane in tension and reinforced concrete as a supporting structure in compression. This method has been limited to sitecast concrete construction using formwork assembled onsite. Slipformed and jumpformed techniques have been developed for sitecast construction. Details and methods of construction are disclosed in U.S. Pat. Nos. 4,403,460, 4,578,921, 4,312,167, 4,327,531, 4,486,989 and 4,660,336.

Sitecast concrete construction requires a continuous, uninterrupted supply of concrete once a pour has been committed and started. Any delays in delivery of concrete to the jobsite or placement into the forms may lead to coldjoints and/or voids or other defects within the pour. Severe weather (such as heavy rain and/or high winds) which render continued onsite activities impractical or unsafe can result in problems. Temperature extremes, either hot or cold, can have a deleterious effect on the structural and aesthetic qualities of the concrete. Mechanical breakdowns of pumping or placing equipment can cause delays in pouring the concrete into the formwork at higher elevations. Sitecast concrete construction also generally requires a site location that is accessible by concrete trucks from a local ready mix concrete plant.

Examples of precast concrete panels use in the construction of structures such as silos are found in U.S. Pat. Nos. 4,324,081 and 4,555,883. The precast concrete panels of these patents are designed to withstand hoop stresses resulting from containment of solids, semiliquids or liquids within the structures built from the panels. They are not designed to withstand substantial vertical loading as is required of a pedestal used to support a large containment structurs such as a large water tank. Consequently, the panels of these patents emphasize reinforcement in the hoop direction and interconnections at the vertical joints of the structure constructed from the panel designed for strength in the hoop direction without significant attention being paid to design features to withstand large continuous vertical loads coupled with side loads resulting from wind forces and other transverse loads which may be created by the forces of nature.

Reference is also here made to U.S. Pat. No. 3,483,704 which is concerned with a precast concrete panel designed for use as a tunnel liner. Here the design effort is directed at producing a panel which may be used to construct tunnelling capable of withstanding significant pressures, from the outside, which produce compressive hoop stresses. As with the panels designed for silo construction there is little need for significant strength parallel to the axis of structures built from the panels and no design emphasis is placed on strength in that direction.

PURPOSE OF THE INVENTION

It is an object of the present invention to provide a precast concrete panel suitable for use in the onsite construction of pedestals or towers for the support of structures such as large water tanks.

It is also an object of the present invention to provide such panels which are economical to produce and which facilitate rapid economic construction of the pedestals or towers concerned.

It is a further object of the present invention to provide a method of constructing pedestals or towers for the support of heavy structures, such as large water tanks, utilizing precast concrete panels of the present invention.

This invention eliminates many of the difficulties associated with sitecast concrete construction. The reinforced concrete panels can be precast prior to the start of onsite construction of the support pedestal. The casting can take place in a controlled environment less sensitive to weather and temperature extremes. The consequences associated with problems encountered during onsite casting into forms are likely to be more severe than precast panels. Larger quantities of concrete are usually involved and requires placement at elevations exceeding 100'. Defects within a pour may cause onsite activities to cease until the extent of the defect is determined and remedial procedures developed. The costs associated with remediation of defects in sitecast concrete can be significant, whereas the worst scenario for precast panels is the rejection of the individual panels.

This invention reduces the length of time required to construct a composite elevated tank. The panels can be cast during the period of time that other preparatory site work, such as grading, excavation and foundation forming and pouring is taking place. The assembling of the precast panels will take less time than onsite jumpformed construction where the forms must be detached and repositioned between each pour and each pour must be given adequate time for curing.

This invention reduces the cost required to construct composite elevated tanks. Because better control can be exercised during precasting than onsite casting, higher strength concrete may be used, thereby reducing the wall thickness and concrete quantities. The shortened construction schedule also reduces construction costs.

SUMMARY OF THE INVENTION

This invention utilizes individual concrete elements or panels which have been precast under controlled conditions in specially manufactured forms to construct, onsite, a pedestal to support, for example, a welded steel tank for the storage of liquids. The method and details of attaching the individual panels to one another so that the completed structure behaves as a shell structure to sustain all anticipated loads is of particular importance. The liquid containing tank, is, for example, a steel shell that is supported atop the concrete pedestal.

According to the invention there is provided a precast concrete panel for use in the onsite construction of pedestals to support structures atop thereof comprising a concrete panel of generally rectangular shape with a substantially constant thickness incorporating steel reinforcement and defining opposed horizontal edges and opposed vertical edges, each said vertical edge incorporating connection means adapted to facilitate connection of that vertical edge to the vertical edge of another similar panel, said connection means being cast into the panel in an overlapping relationship with the reinforcement means to provide structural integrity in the panel between the vertical edges and including metal means projecting from the associated vertical edge for cooperation with a similar means of said other similar panel for secure attachment thereto to provide structural integrity of the connection between panels along adjacent vertical edges thereof, and a bore extending normal to the horizontal edges, from one said horizontal edge to the other, substantially centrally disposed within the thickness of the panel to accommodate means for connecting panels together with their horizontal edges adjoining one another, means being provided for aligning adjacent horizontal edges of similar panels relative to one another with the bores therethrough in alignment.

According to the invention there is also provided a pedestal for the support of structures such as water storage tanks atop thereof a pedestal constructed of panels according to claim 1, said panels being disposed to define a hollow vertical shell defining a vertical axis about which the shell is symmetrically disposed, said pedestal being constructed from said panels connected together along their vertical edges to form horizontal rows of panels stacked one above the other with the horizontal edges of the panels located relative to one another by said alignment means with the bores in alignment throughout the vertical extent of the pedestal, vertical reinforcing means extending throughout the vertical extent of the bores to provide vertical integrity of the structure.

According to the invention there is also provided a method of constructing pedestals for the support of structures such as water storage tanks atop thereof a process of constructing a pedestal for the support of a structure atop thereof comprising providing a foundation with vertical panel alignment rods projecting therefrom, constructing a lowermost horizontal row of panels in the form of a closed geometric figure with vertical bores in engagement with the reinforcement rods projecting from the foundation, passing vertical reinforcement rod segments through said bores of said lowermost horizontal row of panels and connecting these to the rods projecting from the foundation, placing a second row of panels immediately above said lowermost row, said second row of panels being staggered relative to said lowermost row with the bores extending therethrough in alignment with the bores of lowermost row, passing reinforcement rod segments through the bores of said second row and interconnecting these with the rods of the lowermost row, continuing to add horizontal rows of panels to form a vertical pedestal with each row being staggered relative to adjacent rows until the complete pedestal is formed with the reinforcement rod segments forming a continuous reinforcement extending throughout the vertical height of the pedestal.

BRIEF DESCRIPTION OF THE DRAWINGS

The invention will now be described, by way of example, with reference to the accompanying drawings in which.

DETAILED DESCRIPTION OF THE INVENTION

Figure 1:
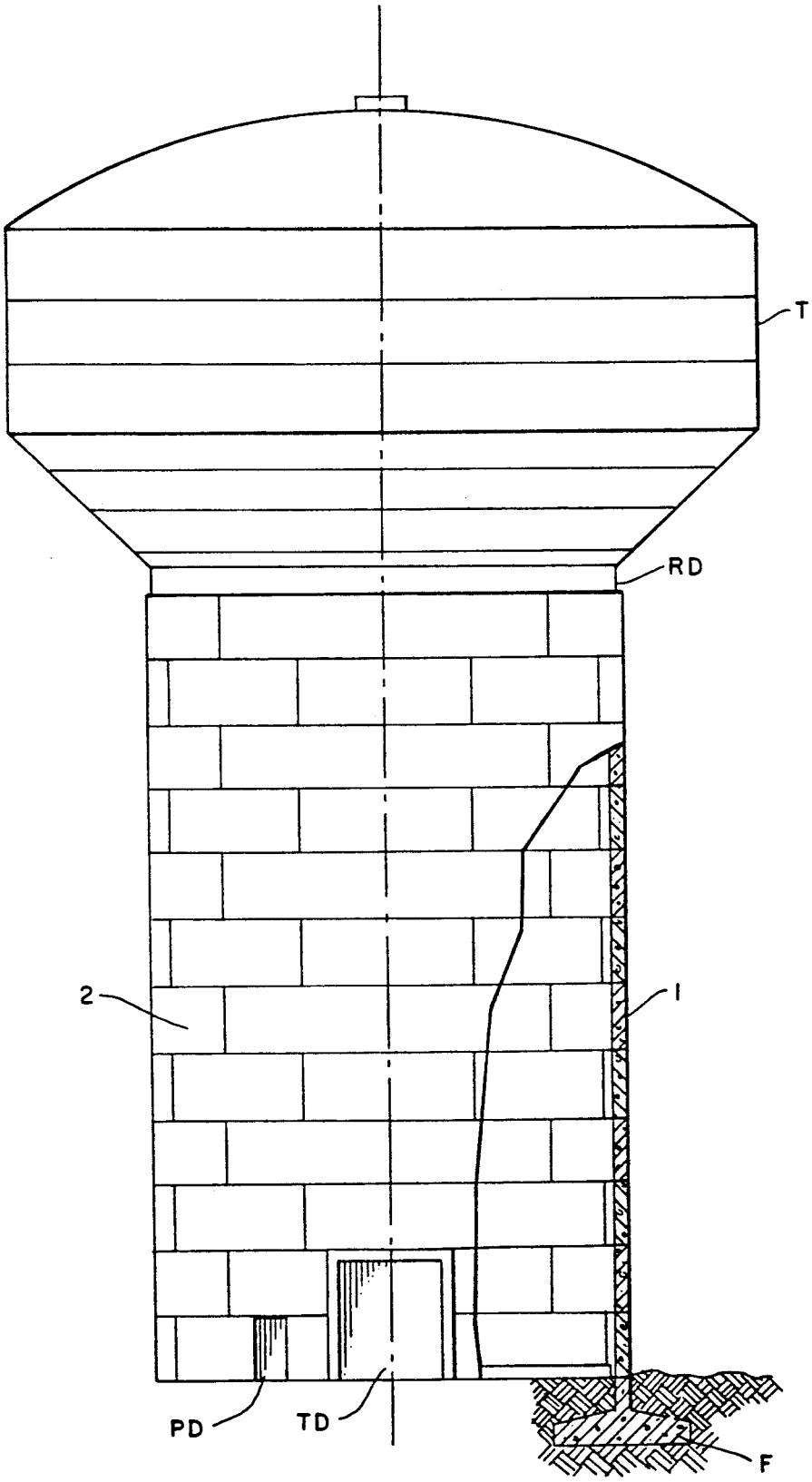
FIG. 1 is a partly sectioned elevation of a pedestal, according to the present invention, with a water tank supported atop thereof, the pedestal being constructed from precast concrete panels, also according to the present invention.

FIG. 1 depicts the general arrangement of a composite elevated tank. Details of the individual precast reinforced concrete panels and joints therebetween are depicted in FIGS. 2 through 10. Continuity through the joints between adjacent panels is provided in the circumferential direction by fabricated steel plates that are embedded in the vertical edges of the panels and are then welded together onsite after the adjacent panels have been erected in their final position. After erection and welding, the spaces in the vertical joints between the panels are filled with a grout in order to provide a weather tight structure. Continuity in the vertical direction as well as attachment of the concrete pedestal to the foundation and steel tank is provided by aligned threaded steel bars that run the full length of the concrete pedestal. The horizontal joint between panels is coated with a bonding adhesive immediately prior to joining adjacent panels together.

With reference first to FIG. 1, the major components for utilizing the inventive concept include a steel storage tank T supported by a reinforced concrete pedestal 1 constructed of numerous individual precast concrete panels 2. The tank and concrete pedestal are supported by a reinforced concrete foundation F. Typically, the concrete pedestal will include an opening TD for a truck access door and a smaller opening PD for a personnel access door. For clarity, details such as reinforcing steel and aesthetic treatments have been omitted in FIG. 1.

As can be seen in FIG. 1, successive rows of panels 2 are staggered relative to one another with each row of panels comprising eight panels disposed to form a horizontal circle, the pedestal 1 being cylindrical and defining a vertical axis symmetrically disposed under the tank T.

Figure 2:
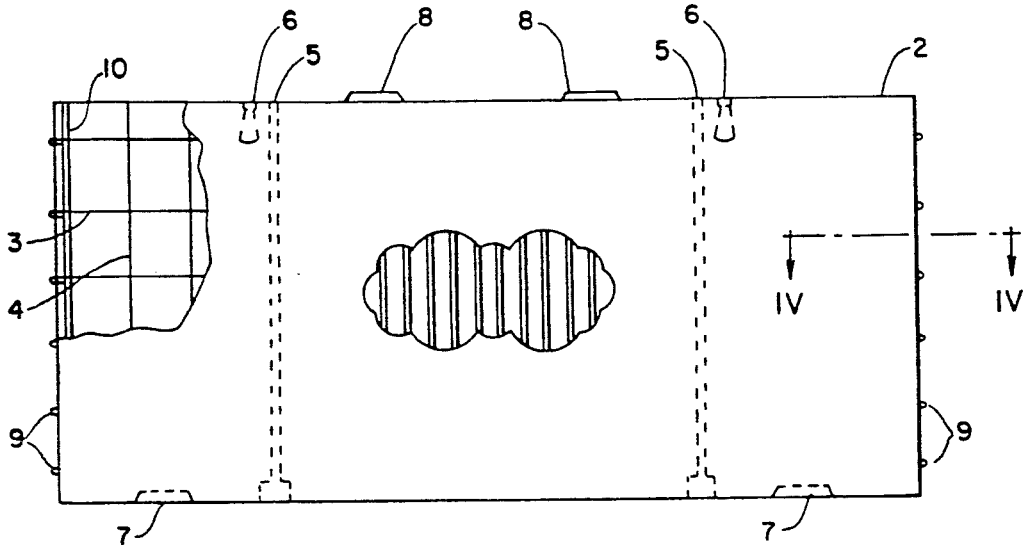
FIG. 2 is an elevation of a reinforced concrete panel, according to the present invention, suitable for use in the construction of the pedestal illustrated in FIG. 1, the exterior pedestal surface of the panel being shown.
Figure 3:
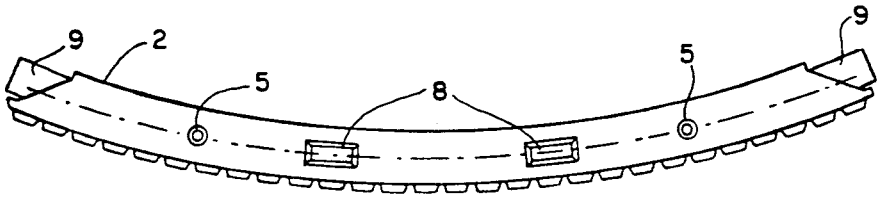
FIG. 3 is a plan view of the panel illustrated in FIG. 2.
Figure 5:
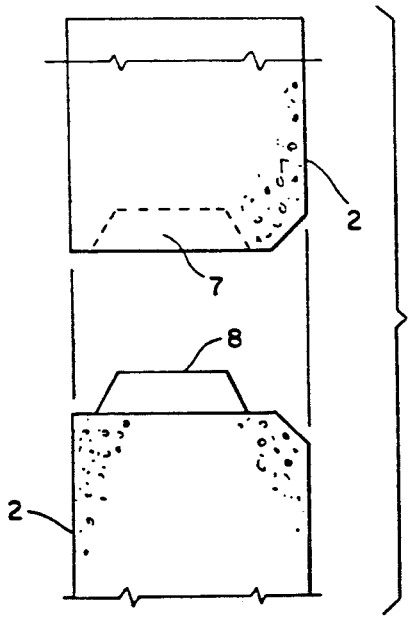
FIG. 5 is a fragmentary vertical section of portions of two panels according to FIG. 2 illustrating means for locating the panels relative to one another when a horizontal joint is formed therebetween.
Figure 4:
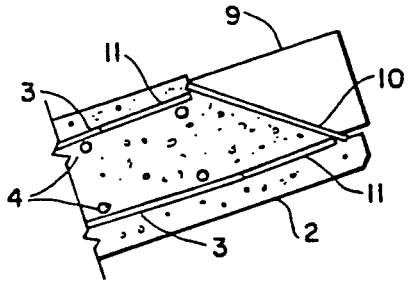
FIG. 4 is a fragmentary sectional plane on section line IV—IV of FIG. 2.

FIGS. 2 through 10 illustrate details of the individual precast concrete panels 2 and joints therebetween. As shown by FIG. 2, each panel is rectangular in elevation and is curved to the radius of the concrete pedestal. As required by the design parameters for each specific location, each panel includes reinforcing steel bars in the horizontal (circumferential) direction 3 and the vertical directions 4. As illustrated, reinforcing steel bars 3 and 4 are spaced 18 inches apart to form two rectilinear parallel grids of reinforcement spaced apart over the elevation of the panel. Additional reinforcement bars may be used adjacent the edges of the panel. Two vertically extending conduits 5 are embedded to allow placement of threaded bars 15 in the vertical direction. To facilitate the staggered arrangement of the panels and the alignment of the conduits 5 from row to row of panels, the conduits are spaced apart by one half of the panels width and are located at one quarter of the panels width from each vertical edge. Threaded lifting inserts 6 are provided to facilitate lifting and handling of the panels. Projecting keys 8 and recessed keyways 7 help align and secure the panels, in the desired staggered arrangement, during erection. The vertical edges of each panel include a fabricated connection system consisting of projecting plates 9 aligned one with each bar 3, vertical plates 10 and anchorage bars 11.

The projecting plates 9 are welded to the vertically extending plate 10 at each edge of the panel while this plate 10 is supported in place by a plurality of anchorage bars 11 of weldable rebar, to which plate 10 is welded, extending into the panel and overlapping adjacent horizontal bars 3, thereby to retain the circumferential integrity of the reinforcing structure. The exterior finish of the pedestal is fragmentarily illustrated in the center of the elevation of FIG. 2. This exterior finish plays no part in the constructional integrity of the panels. Each panel's curvature subtends an angle of 45° degrees so that eight of the panels will complete one complete circumferential row of the pedestal.

Figure 6:
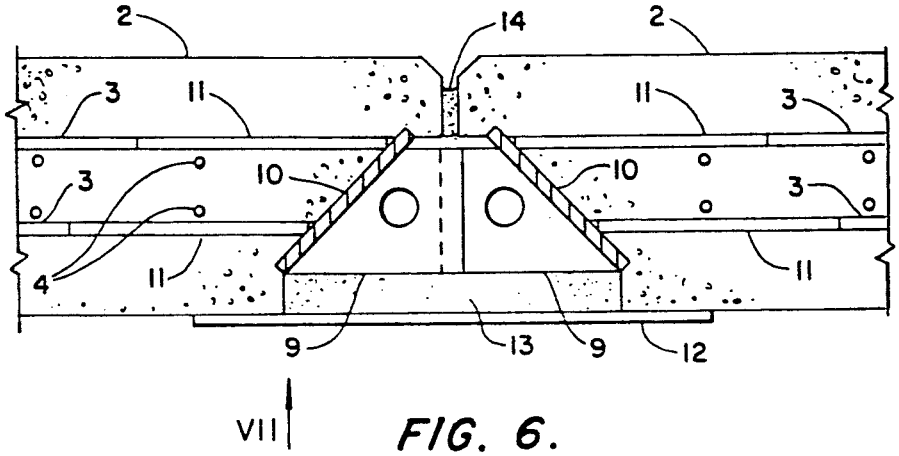
FIG. 6 is a fragmentary horizontal section through a vertical joint between two panels according to FIG. 2, showing the interconnection of those panels.
Figure 7:
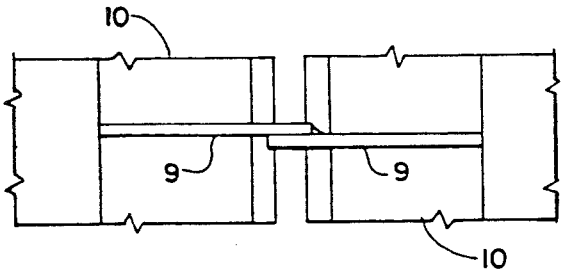
FIG. 7 is a fragmentary elevation in the direction of arrow VII of FIG. 6.

An important feature is continuity in the circumferential direction. Each precast panel must be attached to adjacent panels of the adjacent row such that the completed structure behaves as a shell and is capable of sustaining all anticipated loads. Continuity in the circumferential direction is provided by the embedded connection system 9, 10 and 11. These are fabricated together as assemblies and placed in the forms, together with bars 3 and 4, conduits 5 and threaded inserts 6, prior to pouring concrete. As each precast panel is placed in its final position in the pedestal, the embedded connectors 9, 10 and 11 assist in properly locating the panel. Once properly aligned, the projecting plates 9 between adjacent panels overlap and are welded together, thereby providing continuity with the circumferential reinforcement through the vertical joints between panels. FIGS. 6 and 7 illustrate this joint in detail. After completion of the welding and subsequent inspection, a temporary form 12 is placed over the vertical joint on the inside of the pedestal. Grout 13 is then placed in the void between the panels. A foam backer rod 14 prevents the grout from escaping to the outside of the pedestal.

Figure 8:
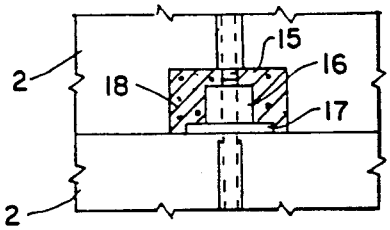
FIG. 8 is a fragmentary view of a horizontal joint between two panels, according to claim 2, at the location of a threaded tension rod installation joining the panels together.

Continuity in the vertical direction is provided by aligned vertical threaded bars 15. FIG. 8 shows typical details at a horizontal joint between panels. A threaded coupler 16 is provided along with a washer plate/centering device 17 at each splice location. The threaded bars are installed in the conduit tubes 5 onsite as the panels are erected. After erection, the tubes are filled with grout 18. The bars 15 act together to provide continuous vertical reinforcement extending from the foundation F to the water tank base plate BP, see FIG. 10.

Figure 9:
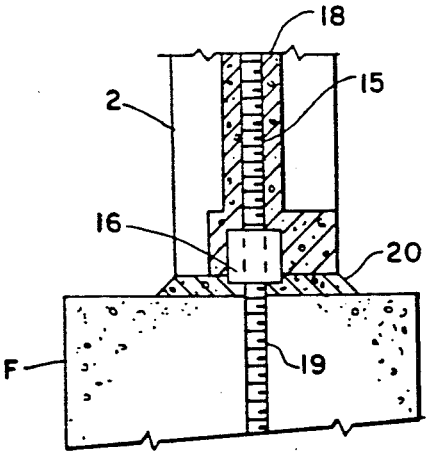
FIG. 9 is a fragmentary vertical section illustrating the joint between the lowermost panel in a pedestal according to the present invention and the pedestal's foundation taken at the location of a threaded tension rod joining that panel and the foundation together.

The bottom row of precast panels is anchored to the foundation by means of the vertical threaded bars 15. As shown by FIG. 9, the bars are attached to threaded bars 19 embedded in the foundation by the use of a threaded coupler 16. The bottom row of panels is levelled with shims which are later removed and the space filled with non-shrink grout 20.

Figure 10:
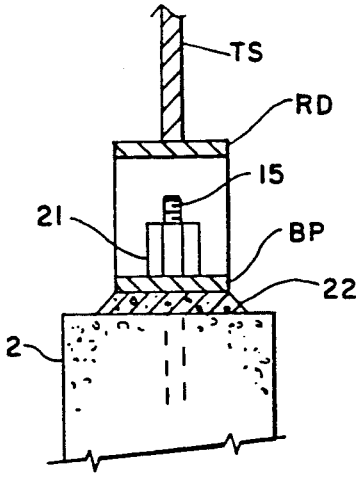
FIG. 10 is a fragmentary vertical section of the joint between the uppermost panel in a pedestal according to the present invention and a water tank support ring taken at the location of a threaded tension rod joining that panel and the ring together.

FIG. 10 illustrates the attachment of the steel tank T to the top of the concrete pedestal. The vertical threaded bars 15 project beyond the top of the uppermost panels and through an opening in the base plate BP of the tank skirt plate TS. A reinforced opening RO provides access through the skirt. Nuts 21 secure the base plate BP to the panels. After levelling the base plate, the void is filled with non-shrink grout 22.

It will be appreciated that there are many variations that may be made to this designer panel without departing from the inventive advance provided by the present invention. However, it is important to retain the continuity of the vertical threaded bar reinforcement in order that the bars, in effect, extend throughout the entire height of the pedestal in one continuous interconnected line. Of course, the segmented bars could be replaced by a single threaded bar (although this may not prove very practical) and the threaded bars themselves could be bars threaded only at their ends as appropriate to provide the necessary interconnection with adjoining bars. Also the threaded bars could, without departing in the inventive advance, be replaced by bars that are welded together during assembly to produce the longitudinally extending reinforcement of a substantially continuous nature (any desired prestress being applied by well known means). Such arrangements will be apparent to those skilled in the art and are not discussed in detail here. Similarly, the vertical joint construction might be varied providing that the circumferential integrity of the pedestal is assured by the manner of interconnecting the panels. However, the construction defined with respect to the vertical joints is economical, reliable and effective thereby providing the best mode of operation of the invention currently known. Similarly the segmented rod vertical reinforcement is the best mode of operation presently known with respect to vertical integrity of the structure provided by this invention.

The associated inventive process for constructing a pedestal in accordance with the present invention involves manufacture of a plurality of the panels described above and their erection to form the desired plurality of staggered circumferential rows of panels (FIG. 1). Initially the base row of panels is supported on the foundation F which carries vertically extending cast in reinforcement threaded rods 19. The base row of panels is shimmed to align them horizontally and threaded rods 15 are inserted through conduits 5 of these base panels and connected to the reinforcement threaded rods 19 by means of threaded couplers 16. At an appropriate point during construction, the shims are removed and a non-shrinkable grout 20 is placed under the lower panels to support them in their horizontally aligned positions. Similarly at an appropriate point in construction the conduits 5 are filled with grout 18 to lock the threaded bars 15 into position. This grout also serves to close the opening which provides access to the threaded couplings 16 during construction.

Subsequent circumferential rows of panels are assembled on top of the base row with their keys and keyways 7 and 8 interacting to align these panels and their conduits 5. Further threaded bars 15 are inserted through the conduits 5 for connection to the threaded bars below by means of couplings 16. In each case, at an appropriate time, the conduits and openings providing access to the couplings 16 are filled with grout.

The top row of panels has the base plate BP of the skirt plate TS placed thereon over extending portions of the upper threaded rods 15. Nuts 21 are used on these threaded rods to anchor the base plate to the pedestal. At appropriate times during construction, any required preload of the threaded reinforcement rods may be provided. Also at an appropriate time, non-shrinkable grout 22 is applied under the base plate to level that plate with respect to the pedestal.

During construction the vertical joints are formed by welding the overlapping plates 9 together and subsequently filling the gaps between the panels with grout as facilitated by the use of the temporary forms 12. Escape of the grout of the outside of the pedestal is prevented by the foam backer rod caulking 14. Horizontal joints are bonded together by an adhesive during construction.

It will be appreciated that while the present invention has been described with respect to the construction of a vertical cylindrical pedestal for support of a water tank, the panel construction is equally applicable to pedestals of other cross-sections, for example, hexagons, octagons, etc. In these alternative designs, the panels would be flat. Additionally, it will be appreciated that although the basic design premise of the present application is directed to the support of vertical loads stemming from water tanks or other structures placed atop the pedestal, the structure is capable of withstanding hoop loads which with appropriate design parameters render the pedestal suitable for the storage of the materials for example, solid materials, semi-liquid materials or liquid materials. This latter use of the construction is, however, secondary to its main purpose to provide a pedestal to withstand substantial continuous vertical loads applied from above.

We claim:

1. A precast concrete panel for use in the onsite construction of pedestals to support structures atop thereof, comprising a concrete panel of generally rectangular shape incorporating steel reinforcement and defining opposed horizontal edges and opposed vertical edges, each said vertical edge incorporating connection means adapted to facilitate connection of that vertical edge to the vertical edge of another similar panel, said connection means being cast into the panel in an overlapping relationship with the reinforcement to provide structural integrity in the panel between the vertical edges and including metal means projecting from the associated vertical edge for cooperation with a similar means of said other similar panel for secure attachment thereto to provide structural integrity of the connection between panels along adjacent vertical edges thereof, wherein said connection means at each vertical edge comprises a metal strip extending along the vertical edge with reinforcement rods of steel welded thereto and extending into the panel in overlapping relationship with the reinforcement and a plurality of connection plates extending from the metal strip beyond the vertical edge for cooperation with similar plates on the vertical edge of an adjacent similar panel, the plates being disposed to overlap the plates of the adjacent panel for connection to these by welding; and the panel further having a bore extending normal to the horizontal edges, from one said horizontal edge to the other, substantially centrally disposed within the thickness of the panel, to accommodate means for connecting panels together with their horizontal edges adjoining one another, and means for aligning adjacent horizontal edges of similar panels relative to one another with the bores therethrough in alignment.

2. A precast concrete panel according to claim 1, wherein the vertical edges of the panel are chamfered to provide access to the plates, while the panels are being connected together along their vertical edges, to facilitate the welding of the plates together.

3. A precast concrete panel according to claim 1, wherein the bores are two in number and are defined by conduits extending through and cast into the panel, from one horizontal edge to the other horizontal edge, parallel to the vertical edge at a distance, one from each vertical edge, of ¼ of the distance between the vertical edges.

4. A precast concrete panel according to claim 3, wherein the alignment means are keys projecting from one horizontal edge and keyways in the other horizontal edge capable of cooperating with the keys to align panels together with the conduits in alignment with one another.

5. A precast concrete panel according to claim 4, wherein the keys and keyways are disposed along the horizontal edges so that adjacent panels connected together along their horizontal edges will be staggered horizontally of those edges closest to one another by half the distance between the vertical edges of a said panel.

6. A precast concrete panel according to claim 1, wherein said panel is curved to provide straight vertical edges and part circular horizontal edges.

7. A pedestal constructed of panels according to claim 2, said panels being disposed to define a hollow vertical shell defining a vertical axis about which the shell is symmetrically disposed, said pedestal being constructed from said panels connected together along their vertical edges to form horizontal rows of panels stacked one above the other with the horizontal edges of the panels located relative to one another by said alignment means with the bores in alignment throughout the vertical extent of the pedestal, vertical reinforcing means extending throughout the vertical extent of the bores to provide vertical integrity of the structure.

8. A pedestal according to claim 7, wherein the vertical bars are installed in tension under a desired prestress.

9. A pedestal according to claim 7, wherein alternate rows of panels are staggered relative to one another by half of the distance between the vertical edges of a said panel.

10. A pedestal according to claim 7, wherein the vertical reinforcement rods comprise a plurality of vertical segments interconnected at the junction between each horizontal row of panels.

11. A pedestal according to claim 10, which each segment is a threaded rod and the interconnection is by means of threaded couplings.

12. A pedestal according to claim 10, further comprising a foundation supporting the pedestal, said foundation incorporating vertically projecting threaded rods for interconnection with the threaded rods in the bores of the lowest horizontal row of panels and a structure supporting ring atop the uppermost horizontal row of panels forming a pedestal which is connected to the pedestal by means of the threaded segments extending through the uppermost horizontal panels.

13. A pedestal according to claim 7, in the form of a right vertical cylinder constructed from curved panels.

* * * * *